US006148877A

United States Patent [19]

Bethke

[11] Patent Number: 6,148,877

[45] Date of Patent: Nov. 21, 2000

[54] FLUID FILLING SYSTEM WITH FILL TIME OPTIMIZATION

[76] Inventor: Steven D. Bethke, 813 Woodward Dr., Madison, Wis. 53704

[21] Appl. No.: 09/296,376

[22] Filed: Apr. 22, 1999

[51] Int. Cl.[7] ..... B65B 3/28

[52] U.S. Cl. ..... 141/103; 141/1; 141/83; 141/196

[58] Field of Search ..... 141/1, 83, 100, 141/103, 104, 196

[56] References Cited

U.S. PATENT DOCUMENTS

| | | | |
|---|---|---|---|
| 2,548,222 | 4/1951 | Kindseth | 141/103 |
| 3,648,741 | 3/1972 | Croasdale et al. | 141/103 |
| 3,651,836 | 3/1972 | Johnson | 141/103 |
| 4,208,852 | 6/1980 | Pioch | 53/167 |
| 4,275,775 | 6/1981 | Egli | 141/83 |
| 4,696,329 | 9/1987 | Izzi | 141/1 |
| 4,895,193 | 1/1990 | Rangwala et al. | 141/103 |
| 5,083,591 | 1/1992 | Edwards e al. | 141/9 |
| 5,105,859 | 4/1992 | Bennett et al. | 141/103 |
| 5,109,894 | 5/1992 | McGregor | 141/83 |
| 5,111,855 | 5/1992 | Boeck et al. | 141/83 |
| 5,148,841 | 9/1992 | Graffin | 141/83 |
| 5,156,193 | 10/1992 | Baruffato et al. | 141/1 |
| 5,159,959 | 11/1992 | Böhm | 141/1 |
| 5,168,905 | 12/1992 | Phallen | 141/1 |
| 5,285,825 | 2/1994 | Townsley | 141/9 |
| 5,505,233 | 4/1996 | Roberts et al. | 141/83 |
| 5,623,976 | 4/1997 | Muscara | 141/83 |
| 5,835,982 | 11/1998 | Lanaro et al. | 141/103 |
| 5,950,691 | 9/1999 | Abe et al. | 141/103 |

OTHER PUBLICATIONS

Neotron System with MicroSet Control, Publication by Mateer–Burt Co., Inc., Wayne, PA, Jul. 1988.

*Primary Examiner*—J. Casimer Jacyna

*Attorney, Agent, or Firm*—Craig A. Fieschko, Esq.; DeWitt Ross & Stevens S.C.

[57] ABSTRACT

A fluid filling system is disclosed wherein containers to be filled with fluid materials are supplied first to one or more time-metered filling stations, and then to a weight-metered filling station. At first, the time-metered filling station(s) is/are inactive, and only the weight-metered filling station is used to fill a first container to a desired final weight. A timer is used to monitor the filling time necessary to reach the desired final weight. When later containers are then supplied to the time-metered filling station(s), they are filled at each time-metered station for a filling time which is dependent on the previously measured filling time for the weight-metered filling station. These containers are then "topped off" by the weight-metered filling station to precisely fill them to the desired final weight, and the time required for such topping off is measured for use in subsequent modification of the filling times at the time-metered filling stations. For each container, the filling time at each time-metered filling station is dependent on the filling time at the weight-metered filling station in such a manner that the two will converge towards each other with successive containers until they are substantially or exactly equal. Preferably, the dependence between the time-metered filling time and weight-metered filling time are such that $$t_{timed}(t)=t_N(t-1)+Q\times[t_N(t-1)-t_{timed}(t-1)]$$

wherein $t_N(t-1)$ is the filling time at the weight-metering filling station for a prior container;

$t_{timed}(t)$ is the filling time at the time-metering filling station for the prior container;

$t_{timed}(t-1)$ is the filling time at the time-metering filling station for the prior container;

Q is a predetermined real number.

17 Claims, 1 Drawing Sheet

FLUID FILLING SYSTEM WITH FILL TIME OPTIMIZATION

FIELD OF THE INVENTION

This disclosure concerns an invention relating generally to methods and apparata for fluid dispensation, i.e., the dispensation of liquids and flowing powders or other solids. The invention relates more particularly to methods and apparata which are particularly suitable for use in automatic and semi-automatic container fillers for filling containers with a desired amount of fluid product.

BACKGROUND OF THE INVENTION

The three most common types of fluid filling schemes are volumetric filling, time-metered filling, and weight-metered filling. All are commonly implemented in semi-automatic or automatic filling systems wherein empty containers are presented by conveyors or other transport mechanisms to filling stations. Once the containers reach the filling stations, they are stopped, filled to the desired degree by nozzles or other dispensing apparata, and then released upon completion of the fill.

In volumetric filling (also known as volume-metered filling), a set volume of fluid is dispensed into a container: a chamber is set to a desired volume, the chamber is filled with product, and the contents of the chamber are then dispensed into a container. Volumetric filling is subject to the disadvantages that filling accuracy is limited by the accuracy of the control of the chamber volume, and filling speed is limited by the time necessary for refilling the chamber. Volumetric filling is also unsuitable where one wishes to fill a container with a desired weight of product: variations in product density will lead to variations in the weight of the product dispensed from the chamber and result in different weights being dispensed into different containers; viscous products may stick to the dispensing apparatus and result in incomplete dispensation; and so forth.

In time-metered filling (also known as time-metered volumetric filling), product is dispensed from a nozzle having a known volumetric flow rate for a set amount of time sufficient to fill the containers with a set volume of product. Time-metered filling is advantageous in terms of productivity insofar as one may reduce filling time per container to any desired level so long as the appropriate volumetric flow rate is obtainable. However, time-metered filling is subject to inaccuracy unless a constant flow rate is precisely maintained, and this is particularly difficult to attain where flow rates are high. Additionally, time-metered filling is subject to the same disadvantages as volumetric filling in that variations in product density will result in different weights of product being dispensed to different containers, even if the volume of the dispensed product remains relatively constant from container to container.

Weight-metered filling utilizes a weight sensor which monitors the amount of fluid received by a container. The weight sensor provides feedback to the dispensing apparatus, which halts dispensation when a desired weight of product is received. Weight-metered filling can be more accurate than volume-metered and time-metered filling, but it unfortunately has several significant disadvantages. First, the weight sensors and feedback apparata are quite costly if any reasonable degree of accuracy is required. Second, the filling time per container tends to be significantly longer owing to the weight feedback; sensitive weight sensors need time to "settle" prior to giving accurate weight readings, and additionally slower filling rates must often be used since the flow must be cut off precisely at or slightly before the time the desired weight is reached, or overshoot will result in an overweight container with product "give-away".

To address the shortcomings of these individual filling schemes, prior inventors have developed "hybrid" filling systems which use a combination of schemes in an attempt to attain better filling accuracy and/or higher product throughput. Initially, prior systems exist wherein time-metered filling and weight-metered filling are both used. U.S. Pat. No. 4,208,852 to Pioch describes a filling unit which forms, fills, and seals containers (e.g., column 1 lines 51–57). With reference to FIG. 1 of that patent, a container producing station 10 produces two containers at a time by use of two molds 20 (e.g., column 3 lines 10–29). The two containers are then indexed to a filling station 12, which includes four filling nozzles (e.g., column 4 lines 46–64; column 5 lines 43–62). The first two filling nozzles utilize time-metered filling to initially fill the two containers simultaneously, and the second two filling stations, which incorporate weight sensors, use weight-metered filling to complete the filling of the two containers to a desired weight. Thus, weight-metered filling is used for "topping off" the containers to a desired weight after time-metered filling, thereby correcting any inaccuracies in the time-metered filling. Closing stations 13 and 14 then close the containers.

Several systems are similar to Pioch in that they use time-metered filling with subsequent weighing of filled containers, but they do not use weight-metered filling. Instead, they use weight sensors to weigh the containers after they are filled, and the weight sensors then supply a correction signal to the time-metered filling stations if appropriate (i.e., they use weight sensors to "check-weigh" time-filled containers).

Examples of such systems are provided in the following patents.

U.S. Pat. No. 4,696,329 to Izzi describes a time- or count-metered filling unit wherein the containers are weighed after filling. After a first batch of containers is filled by a time-metered filling station, the weights of the containers in this first batch are averaged to derive a time correction signal for later containers if there is deviation between the measured weight and the desired weight (e.g., column 5 lines 51–60). If the containers are underweight, filling time is increased; if the containers are overweight, filling time is decreased; and if the container weights are within a preset tolerance band, filling time is left constant. Later batches of containers are similarly weighed to update the time correction for further containers. The weight sensor used to measure the container weights is located off-line of the conveyor that carries the containers beneath the time-metered filler (i.e., the weight sensor is not located at a filling station; see, e.g., column 4 lines 52–58).

U.S. Pat. No. 5,156,193 to Baruffato et al. describes a filling system wherein a weight sensor determines the tare weight of a container, the container is filled at a filling station via time-metered flow, and then the filled container is then finally weighed so that deviation from the desired weight can be used to modify the filling time (column 6 line 23-column 7 line 3).

U.S. Pat. No. 5,285,825 to Townsley describes a device for filling containers wherein containers are weighed at a first weighing station to obtain a tare weight, filled at first and second filling stations by time-metered filling (e.g., column 8 lines 3–13), and then weighed at a final weighing station to get the filled weight. Corrections to the fill time for subsequent containers are supplied to the filling nozzles based on average values of tare weight and gross weight for some number of containers.

U.S. Pat. No. 5,159,959 to Bohm is similar to the Izzi, Baruffato et al., and Townsley filling schemes, but it uses volumetric filling rather than time-metered filling. Volumetric charges of material are delivered to containers, and the containers are then weighed. Weight offsets (i.e., deviations from the desired final weight) are used to generate a correction signal which appropriately adjusts the volumetric chamber to produce a charge having the correct weight. As in Izzi, the weight offsets and correction signal may be generated from a number of filled packages rather than a single one so as to produce an "average" correction signal. A good summary of the invention is provided at column 2, line 12 onward.

There are also filling schemes similar to those of Izzi, Baruffato et al., and Townsley, but wherein weight sensors are provided at the time-metered filling stations rather than at separate locations. U.S. Pat. No. 5,109,894 to McGregor uses a weight sensor to support a container and fills the container by time-metered filling (more specifically, by counting revolutions of a dispensing auger). The weight sensor measures the weight of the filled container and adjusts the filling time if the desired product weight is not obtained (e.g., column 7 line 52-column 8 line 29).

U.S. Pat. No. 5,083,591 to Edwards et al. describes an automated system for dispensing volume- and weight-metered amounts of pigments and paint base into containers to obtain paint having a desired final color. As noted at column 3 line 53-column 4 line 18, the apparatus may include one or more filling stations, each having a weighing platform whereupon a container is placed during filling. The container is volumetrically filled. The weight sensor then determines whether the container is overweight or underweight; if it is underweight, more paint is added (e.g., column 20 lines 24–60), and if it is overweight, the controller will try to adjust the blending formula so that the proper paint color will still be obtained after subsequent filling steps are completed. Each filling station has a plurality of nozzles (each nozzle for a different pigment or base), and they may additionally be provided with multiple weight sensors, each sensor having a different tolerance so that addition of materials in different weight ranges can be more accurately metered (e.g., column 23 lines 12–44).

One system is known which provides weight-metered filling with a sort of time feedback (as opposed to the systems of Izzi, Baruffato et al., etc. above, which use time-metered filling with weight feedback). U.S. Pat. No. 5,148,841 to Graffin describes a filling unit with multiple filling nozzles for filling multiple containers. The nozzles are supplied with product from a reservoir, and each nozzle is controlled by a weight sensor which monitors the fill weight of its container and terminates flow when a desired weight is reached (e.g., column 3 lines 7–21). As noted at column 3 lines 40–58, timers are included to monitor the time needed to achieve the proper weight in each container, and the measured times are used to control the amount of material in the reservoir so that it has the desired dispensing pressure for future containers, thus establishing desired flow rates among the nozzles. As noted in columns 1 and 2, such desired flow rates may be chosen to avoid foaming, to provide an initial rapid fill rate and a later dribble fill rate for topping off containers, etc. Additionally, as noted at column 5 lines 26–38, this system allows the reservoir's product level to be adapted to provide a constant desired flow rate to each nozzle when one or more nozzles are either placed in service or out of service. Thus, filling of containers is ultimately done by weight (the weight error signals are not used to alter product flow rates), and time measurements are used to determine whether the fill rate is suitable to avoid product foaming or other undesirable artifacts of inappropriate fill times. In some embodiments of the invention, if a weight sensor is faulty, the filling for its nozzle will then be performed solely by time-metered filling (e.g., column 4 lines 23–30).

While these hybrid filling schemes address some of the disadvantages of the individual volume-metered, time-metered, and weight-metered filling methods, they can also combine and compound some of their disadvantages. There is thus still a need for a filling method which provides the accuracy of weight-metered filling, while at the same time avoids its implementation costs and undesirably long filling times.

SUMMARY OF THE INVENTION

To assist the reader's understanding, a particular preferred version of the invention will now be summarized, it being noted that the true scope of the invention is defined by the claims set out at the end of this disclosure.

Containers to be filled with fluid products are supplied in succession to a series of filling stations: first, to one or more time-metering filling stations, and second, to a weight-metered filling station. All time-metering filling stations are set to fill each container for the same amount of time $t_{timed}$, while the weight-metered filling station fills the container for some amount of time $t_N$ necessary to fill the container to a desired final weight (with $t_N$ possibly varying from container to container owing to differences in container tare weight, etc.). The time $t_{timed}$ need not remain constant in successive containers, however, and it preferably varies in accordance with $$t_{timed}(t)=t_N(t-1)+Q\times[t_N(t-1)-t_{timed}(t-1)]$$

wherein

- $t_{timed}(t)$ is the filling time at the time-metering filling station(s) for the container presently at the station(s);
- $t_N(t-1)$ is the filling time at the weight-metering filling station for the prior container;
- $t_{timed}(t-1)$ is the filling time at the time-metering filling station(s) for the prior container; and
- Q is a predetermined constant real number which is preferably set to a value between −1.0 and 1.0.

It can be seen that by use of this scheme, as successive containers proceed through the filling stations, $t_{timed}(t)$ will converge towards $t_N(t)$ (wherein $t_N(t)$ is the filling time at the weight-metering filling station for the present container). Therefore, the time-metered and weight-metered filling stations will each eventually perform filling for the same (or substantially the same) amount of time, and no station will "hold up" the line or sit idle while other stations are operating. Since weight-metered filling is used to top off each container, each container is filled to a desired net weight as accurately as if solely weight-metered filling was used. However, since the container is in large part filled by use of the faster time-metered filling scheme, the invention does not suffer from the slow filling times of weight-metered filling. Additionally, the system's use of only a single weight sensor and feedback system (at the weight-metered filling station) greatly reduces the cost of the system in comparison to systems wherein multiple weight-metered filling stations are used.

It is therefore seen that the invention obtains the accuracy advantages of weight-metered filling and the speed and cost advantages of time-metered filling. More advantageously, because the invention optimizes the filling times between all filling stations, it is found to result in higher productivity than prior systems which combined weight- and time-metered filling. As an example, in the system of Pioch, containers are filled by time-metered filling and then topped off by weight-metered filling, but no attempt is made to relate the time-metered and weight-metered fill times to enhance efficiency. In Pioch, the weight-metered filling time can be said to be dependent on the time-metered filling time (since longer time-metered filling times will result in less weight to be added to completely fill the containers), but the reverse is not strictly true; the time-metering fill time is preset, and is unaffected by the weight-metering fill time. The invention is also fundamentally different from prior systems such as Izzi, Baruffato et al., Townsley, Bohm, McGregor, and Edwards et al. in that the weight filling stations or weight sensors of these prior systems essentially strive for redundancy: once the weight feedback adjusts the filling times/volumes to attain the correct filling weight, the weight sensors are essentially rendered unnecessary—assuming uniformity in the product, containers, and filling apparatus, there is no longer any need for the weight sensors since the desired weight has been attained. In contrast, the present invention fully utilizes a weight filling station to fill each container.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
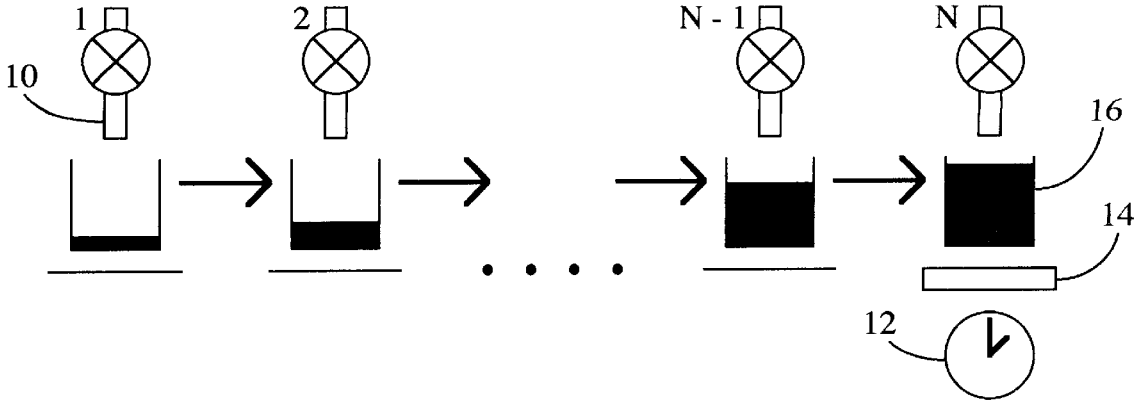
FIG. 1 is a schematic side elevational view of a container being moved among successive filling stations and being partially filled at each station.

Referring to FIG. 1 of the drawings, an exemplary time-optimized fluid filling system in accordance with the present invention is shown. Assume there are N filling stations, the first N-1 stations (stations 1, 2, . . . N-2, N-1) using time-metered filling and the final station N using weight-metered filling. At each station, a filling nozzle 10 is shown, with the final filling station N also including a timer 12 (e.g., a controller with an incorporated clock) and a weight sensor 14. The total time T to fill a container 16 is $$T=t_1+t_2+\ldots+t_{N-1}+t_N$$

where $t_1$ represents the time for filling at the first filling station, $t_2$ is the time for filling at the second filling station, etc.

For the system to achieve the most rapid throughput of containers without a "bottleneck" in the filling process, the ideal case would be $$t_1=t_2=\ldots=t_{N-1}=t_N$$

so that no filling station would "hold up" the line, or conversely no nozzle would sit inactive while others are filling (thereby requiring that the other nozzles fill for a longer time to make up for the idle nozzle's inactivity).

Since stations 1 through N−1 are time-metered filling stations, their fill times $t_1, t_2, \ldots t_{N-1}$ are known beforehand: the controller or operator sets them, or at least sets their initial values. If we consider the preferred case that fill times at all of the time-metered filling stations are equal, $t_1=t_2=\ldots=t_{N-1}$. If we then reexpress these times $t_1, t_2, \ldots t_{N-1}$ as $t_{timed}$ (i.e., $t_1=t_2=\ldots=t_{N-1}=t_{timed}$), the total filling time may be reexpressed as $$T=t_1+t_2+\ldots+t_{N-1}+t_N$$
$$=\sum_{n=1}^{N-1} t_{timed}(n)+t_N$$

And in the ideal case where filling times at all filling stations are equal, $$t_{timed}=t_N$$

and thus $$T=t_1+t_2+\ldots+t_{N-1}+t_N$$
$$=\sum_{n=1}^{N} t_{timed}(n)$$

However, in practice, $t_N$ may not equal $t_{timed}$ since $t_N$ is (in essence) equal to $t_{timed}$ plus some "correction" time (either positive or negative) needed to have a container meet the desired final weight.

In operation, the most preferred implementation of the invention works as follows. The fill time at the timed filling stations, $t_{timed}$ ($t_1$, $t_2$, etc.) is initially set to zero. The first container is therefore transferred directly to the weight filling station N and is filled to the set weight. The controller/timer 12 measures the time $t_N$ required to fill to the set weight.

In subsequent filling cycles, the controller/timer 12 sets the fill time $t_{timed}$ for each of the timed filling stations using the following formula:

$$t_{timed}(t)=t_N(t-1)+Q\times[t_N(t-1)-t_{timed}(t-1)]$$

where t designates the current filling cycle and t−1 represents the prior filling cycle (i.e., $t_N(t-1)$ designates the fill time of the weight filling station in the prior filling cycle, $t_{timed}(t-1)$ designates the fill time of each timed filling station in the prior fill cycle, and $t_{timed}(t)$ designates the fill time of each timed filling station in the current fill cycle). Q is a constant which determines the degree of change applied to the filling times at the timed filling stations. Q may be set as desired (and may be positive or negative), but values between 0.05 and 0.25 are preferred, with a value of 0.10 being most commonly used.

To illustrate, consider that in the first filling cycle (t=1), $t_{timed}(1)$ will be zero while $t_N(1)$ will be some nonzero value (the time required for complete weight-filling of the container). In the subsequent cycle (t=2), $$t_{timed}(2)=t_N(1)+Q\times[t_N(1)-0]$$
$$=(1+Q)\times t_N(1)$$

In the next cycle (t=3), $$t_{timed}(3) = t_N(2) + Q \times [t_N(2) - t_{timed}(2)]$$

$$= t_N(2) + Q \times [t_N(2) - (1 + Q) \times t_N(1)]$$

It should be kept in mind that $t_N(2)$ will be less than $t_N(1)$ owing to the amounts filled in the container at the previous timed filling stations in the line.

It is seen that in subsequent cycles, $t_{timed}(t)$ and $t_N(t)$ will converge towards each other until they are equal (or approximately so, since $t_N(t)$ may vary slightly from cycle to cycle since it must compensate for minor differences in container weight from container to container, differences in amounts added in the various timed filling stations owing to product irregularity or other factors, etc.). Since the system will (within several cycles after start-up) meet or closely approximate the ideal case of $t_{timed}(t)=t_N(t)$, production is maximized: no containers cause "bottlenecks" by having longer filling times, nor does the line "waste" time by having one filling station sit inactive while other filling stations are operating. Furthermore, if the time-metered filling stations do not each fill the container by an equal amount owing to differences in product density in the lines to these stations, this will not generate filling inaccuracies since the final filling station will top off the container to the precisely desired weight. The system is also advantageous insofar as all filling and fill times may be performed automatically, without the need for operator intervention or the need to input initial values for fill times. Additionally, while the invention results in containers filled very accurately to a desired weight, it does so much faster than in prior filling systems which use only weight-filling stations. Finally, because the invention need only utilize a single weight sensor, it is far less expensive than prior systems wherein multiple weight-filling stations are used.

Figure 2:
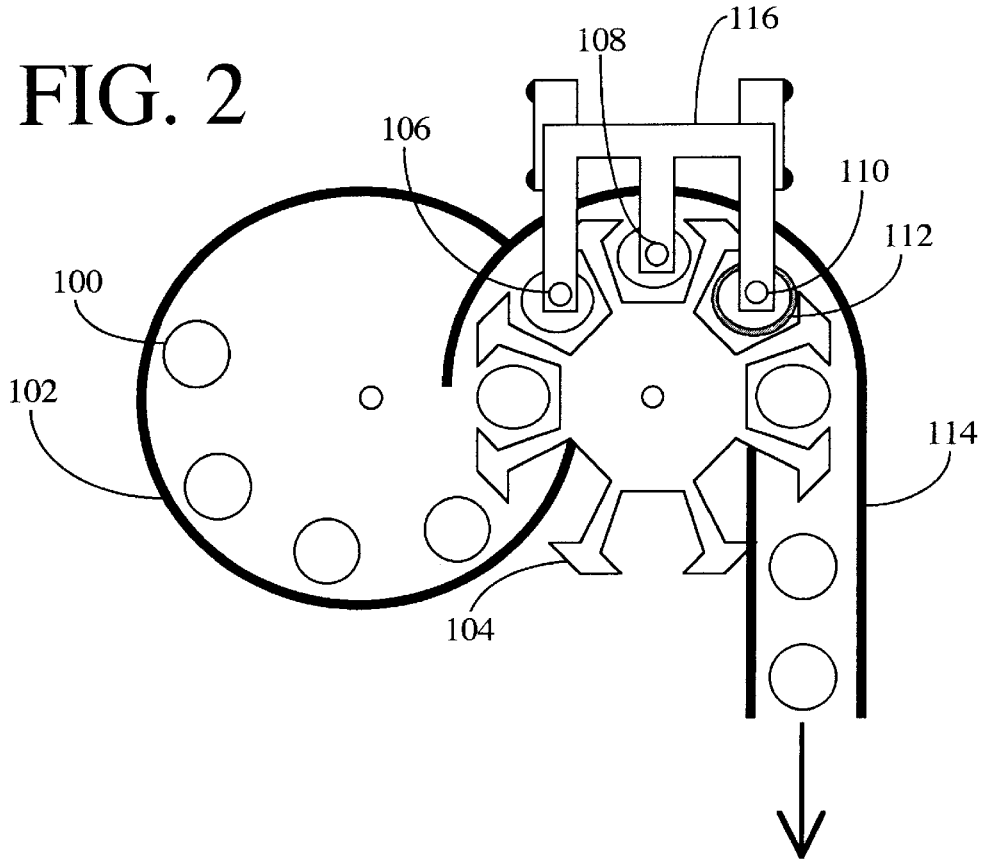
FIG. 2 is a schematic top plan view of an exemplary implementation of the invention, wherein a rotary accumulation table feeds empty containers to a rotary indexer, the rotary indexer moves the containers beneath three filling nozzles provided on a mobile fill cart, and the filled containers are then removed from the rotary indexer on a linear conveyor.

FIG. 2 then illustrates an exemplary implementation of the invention. Empty containers 100 are placed on a rotary table accumulator 102, which then presents the containers 100 to a six-station rotary indexing dial 104. The rotary indexing dial 104 indexes each container 100 past a first time-metering filling nozzle 106, a second time-metering filling nozzle 108, and a weight-metering filling nozzle 110. Beneath the indexer 104 and the weight-metering filling nozzle 110, a weight sensor 112 is provided along the path of the containers so that their weight may be sensed and used to actuate weight-metered filling. After the container is filled by weight by nozzle 110, it is released onto a conveyor 114 for further processing. Most preferably, the nozzles 106, 108, and 110 are provided on a wheeled mobile filling cart 116 which is capable of being moved to and from different filling locations, and which bears a data line or other connection that plugs into a controller at the filling location to receive filling nozzle actuation signals in response to the measured container weight, filling times, etc. It is noted that mobile filling carts which plug into a filling location at which a weight sensor is located are known to the art, and have been sold since at least 1989 by the GEI Mateer Burt Co. (Wayne, Pa., USA) in the form of its Neotron Series 1200 filler with MicroSet control system. Other fillers of this type are illustrated, for example, by U.S. Pat. No. 5,505,233 to Roberts.

It is noted that the exemplary implementation of the invention shown in FIG. 2 is provided for the purpose of illustration, and that a variety of other implementations are possible; the filling nozzles could be stationary with respect to the filling positions rather than mobile, filling could be implemented on linear or other transport/conveying mechanisms rather than rotary ones, etc. Following are descriptions of several other exemplary implementations.

Initially, the invention may be adapted for use to fill a variety of types and sizes of containers, and to use any number of time-metered filling stations. In general, the larger the container, the more beneficial it will be to add additional time-metered filling stations for faster filling. As noted above, the invention may be adapted to a variety of container transfer arrangements, e.g., linear inline conveyor systems, lateral transfer inline conveyor systems, indexing rotary conveyor systems.

It is noted that the weight filling station may be of the "weighed filling" type (i.e., the material received in the container is weighed), or may instead be of the "weighed dispensing" type (i.e., the dispensed material is weighed prior to and/or during dispensation, and its weight should be the same as the material received by the container so long as material delivery is properly executed).

When weighed filling is used, it is noted that the controller can impose a "pre-act" on the weight-filling nozzle such that the nozzle shuts off shortly prior to the time the weight sensor measures the desired weight. This can compensate for material "in flight" between the nozzle and the container, which is not yet received by the container and thus not yet weighed, so that the precise weight of material is received by the container very shortly after the nozzle shuts off. Alternatively or additionally, the well-known "bulk-and-dribble" filling scheme may be used wherein the weight filling station initially performs a rapid fill at high flow rates, and then slows the flow rate so as to allow the filling to cut off at a more precise weight.

It should be understood that when the invention is described as using a timer 12 for measuring the times of weighed filling and timed filling, this is considered as encompassing the situation wherein separate timers are used at the various filling stations, e.g., one measuring the time of weighed filling at the weight-metered filling station and one at all (or each) of the time-metered filling stations for actuating timed filling at these stations. Since the invention is most preferably implemented using programmable logic controllers (PLCs) or other digital controls, and since such controllers will generally be capable of performing all time-monitoring and actuation functions with a single clock/timer, only a single timer is shown in the Figures, even though this single timer performs timing functions for all filling stations.

It should also be understood that while the preferred embodiment of the invention is contemplated as providing containers in succession to one or more time-metered filling stations and a single weight-metered filling station, other embodiments of the invention, which are less preferred, may utilize more than one weight-metered filling station; for example, a first weight-metered filling station might provide bulk (rapid) filling to some preset percentage of the desired ultimate container weight (e.g., 90%), and a second one might then provide dribble (slow) filling to the final weight. In this case, one may set $t_N$ in the foregoing algorithm equal to the filling time of one of the weight-metered filling stations, or alternatively to the average of the filling times of all of the weight-metered filling stations.

While the invention most preferably uses PLCs for providing control functions, other digital controllers (e.g., personal computers running control programs) or analog controllers (e.g., hard-wired control circuits or mechanical timers/actuators) could be used instead.

In summary, the invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A fluid filling apparatus comprising:

a. a time-metering filling station having a time-metering filling nozzle, the time-metering filling nozzle being settable to (1) a timed filling state wherein a timed fill is executed, or (2) a closed state;

b. a weight-metering filling station having a weight sensor and a weight-metering filling nozzle, the weight-metering filling nozzle being actuated by the weight sensor to be in (1) a weighed filling state wherein a weighed fill is executed, or (2) a closed state;

c. a timer which (1) measures the time of the weighed filling state, and (2) sets the time of the timed filling state, this time being dependent on the time of the weighed filling state.

2. The fluid filling apparatus of claim 1 wherein after a first timed fill, the time of the timed filling state in subsequent timed fills converges toward the time of the weighed filling state in subsequent weighed fills.

3. The fluid filling apparatus of claim 2 wherein the time of the timed filling state in subsequent timed fills is dependent on:

a. the time of the weighed filling state in prior weighed fills, and b. the time of the timed filling state in prior timed fills.

4. The fluid filling apparatus of claim 3 wherein the time of the timed filling state in subsequent timed fills is substantially equal to:

$$t_{timed}(t)=t_N(t-1)+Q\times[t_N(t-1)-t_{timed}(t-1)]$$

wherein $t_{timed}(t)$ is the time of the timed filling state;

$t_N(t-1)$ is the time of the weighed filling state for the prior weighed fill;

$t_{timed}(t-1)$ is the time of the timed filling state for the prior timed fill; and Q is a predetermined real number.

5. The fluid filling apparatus of claim 1 wherein at least one of the filling nozzles is situated on a cart, the cart being movable with respect to the weight sensor.

6. The fluid filling apparatus of claim 1 further comprising at least two time-metering filling stations having the same time for their timed filling states.

7. An apparatus for filling containers comprising:

a. a time-metering filling station which receives individual containers in succession to execute a timed fill, the time-metering filling station including a time-metering filling nozzle having a timed filling state wherein the timed fill occurs and a closed state;

b. a weight-metering filling station which receives individual containers in succession from the time-metering filling station to execute a weighed fill, the weight-metering filling station including:

(1) a weight sensor which receives each container, and (2) a weight-metering filling nozzle actuated by the weight sensor to be in a weighed filling state wherein the weighed fill occurs or a closed state;

c. a timer which:

(1) measures the time of the weighed filling state of the weight-metering filling station;

(2) sets the time of the timed filling state, this time being dependent on the time of the weighed filling state.

8. The fluid filling apparatus of claim 7 wherein after a first timed fill of a first container, the times of the timed filling states for later containers converge toward the times of the weighed filling states for the later containers.

9. The fluid filling apparatus of claim 7 wherein for each container, the time of the timed filling state is set in dependence on:

a. the time of the weighed filling state for a prior container, and b. the time of the timed filling state for the prior container.

10. The fluid filling apparatus of claim 9 wherein for each container, the time of the timed filling state is set to:

$$t_{timed}(t)=t_N(t-1)+Q\times[t_N(t-1)-t_{timed}(t-1)]$$

wherein $t_{timed}(t)$ is the time of the timed filling state;

$t_N(t-1)$ is the time of the weighed filling state for the prior container;

$t_{timed}(t-1)$ is the time of the timed filling state for the prior container; and Q is a predetermined real number.

11. The fluid filling apparatus of claim 10 wherein $-1.0 \leqq Q \leqq 1.0$.

12. The fluid filling apparatus of claim 11 wherein $\pm 0.05 \leqq Q \leqq \pm 0.25$.

13. The fluid filling apparatus of claim 7 wherein at least one of the filling nozzles is situated on a cart, the cart being movable with respect to the weight sensor.

14. The fluid filling apparatus of claim 7 further comprising at least two time-metering filling stations having the same time for their timed filling states.

15. A method of filling containers with fluid substances comprising:

a. providing a series of containers in succession to a time-metering filling station, wherein each container is filled for a time $t_{timed}(t)$;

b. providing the series of containers in succession to a weight-metering filling station, wherein each container is filled for a time $t_N(t)$ to fill the container to a desired weight;

wherein $$t_{timed}(t)=t_N(t-1)+Q\times[t_N(t-1)-t_{timed}(t-1)]$$

in which $t_N(t-1)$ is the filling time at the weight-metering filling station for a prior container; and $_{ttimed}(t-1)$ is the filling time at the time-metering filling station for the prior container; and Q is a predetermined real number.

16. The method of claim 15 wherein $-1.0 \leqq Q \leqq 1.0$.

17. The method of claim 16 wherein $\pm 0.05 \leqq Q \leqq \pm 0.25$.

* * * * *